United States Patent [19]

Collingborn

[11] Patent Number: 5,035,587

[45] Date of Patent: Jul. 30, 1991

[54] FUEL PUMPING APPARATUS

[75] Inventor: Peter A. G. Collingborn, Kent, England

[73] Assignee: Lucas Industries, Solihull, England

[21] Appl. No.: 614,373

[22] Filed: Nov. 15, 1990

[30] Foreign Application Priority Data

Nov. 23, 1989 [GB] United Kingdom ..... 8925477

[51] Int. Cl.[5] ..... F04B 29/00; F04B 23/00; F02M 37/04

[52] U.S. Cl. ..... 417/462; 417/440; 123/447; 123/450; 123/506

[58] Field of Search ..... 417/462, 440; 123/447, 123/450, 506

[56] References Cited

U.S. PATENT DOCUMENTS 4,224,903 9/1980 Mowbray ..... 123/506
4,489,697 12/1984 Kawatei ..... 123/506
4,530,337 7/1985 Laufer ..... 123/506
4,932,844 6/1990 Glanvall ..... 417/440
4,936,755 6/1990 Greeves et al. ..... 417/462

*Primary Examiner*—Leonard E. Smith
*Assistant Examiner*—Alfred Basichas
*Attorney, Agent, or Firm*—Abelman, Frayne, Rezac & Schwab

[57] ABSTRACT

A fuel pumping apparatus has a pumping plunger operable by a cam to deliver fuel to an outlet. A spill valve is provided which when open permits fuel to spill from the bore in which the pumping plunger is located. An actuating piston is located in a first cylinder and is coupled to the spill valve and a storage piston is located in a second cylinder connected to the first cylinder. A control valve controls the pressure in the first cylinder and when the pressure is raised the actuating piston lifts the spill valve from the seating and the fuel from the bore can flow into the first cylinder and when the actuating piston is displaced therefrom, into the second cylinder.

2 Claims, 1 Drawing Sheet

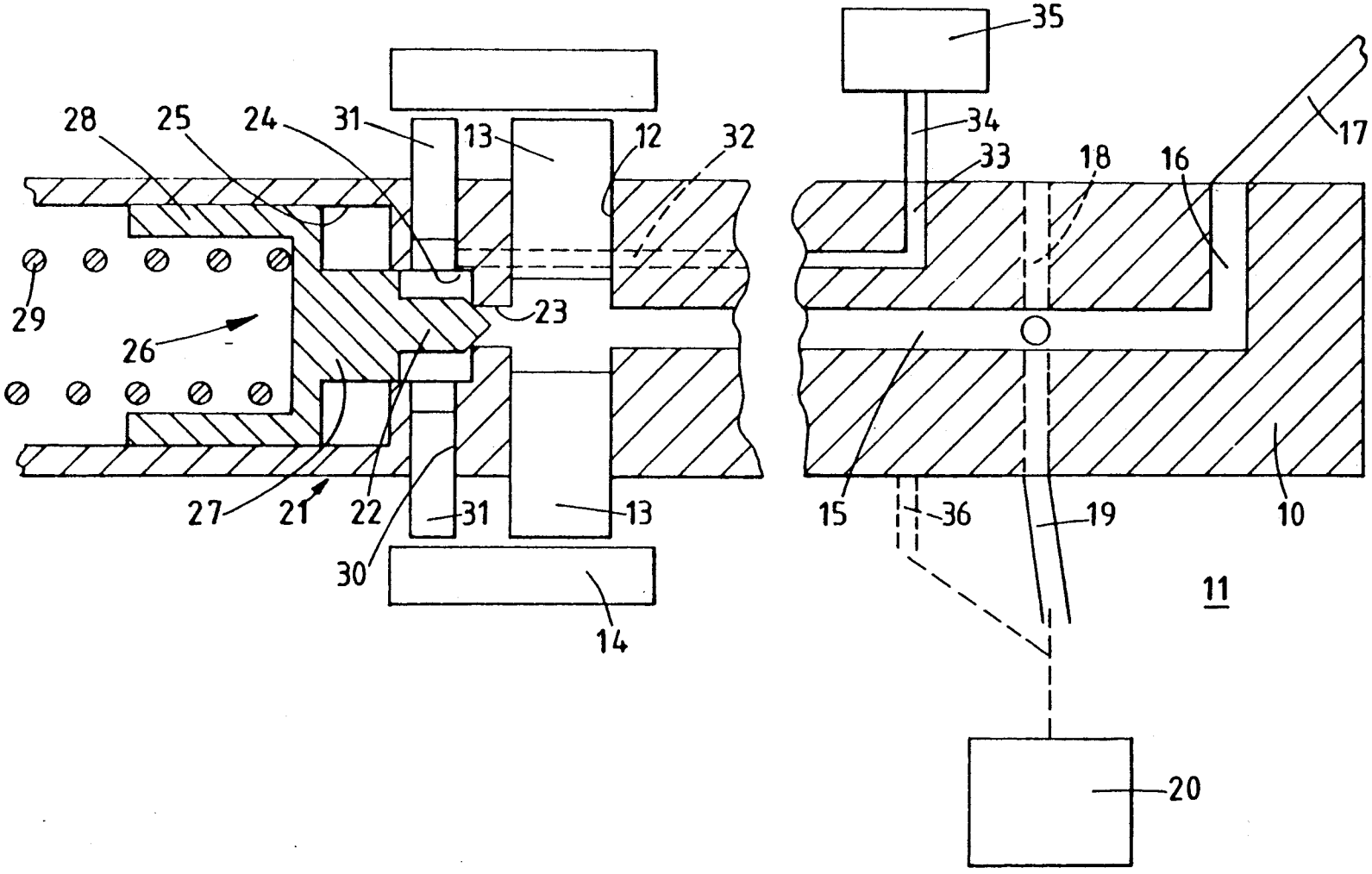
17
10
11
16
20
18
19
35
34
33
36
15
32
12
13
14
23
13
31
31
22
30
24
21
25
27
26
28
29

FUEL PUMPING APPARATUS

This invention relates to a fuel injection pumping apparatus of the kind comprising a pumping plunger reciprocable in a bore, an outlet from the bore and through which fuel can be displaced during the inward movement of the plunger under the action of cam means and a spill valve operable during the inward movement of the plunger to spill fuel from said bore thereby to determine the quantity of fuel supplied through said outlet.

The object of the invention is to provide an apparatus of the kind specified in a simple and convenient form.

According to the invention said spill valve includes a valve member engagable with a seating, said seating surrounding a spill passage from said bore, resilient means biasing the valve member into engagement with the seating, an actuating piston coupled to said valve member, said actuating piston being slidable within a first cylinder into which said spill port opens, the actuating piston defining a surface against which fluid pressure in said first cylinder can act to lift the valve member from the seating, a second cylinder of larger diameter than the first cylinder and into which the first cylinder opens, a storage piston slidable in the second cylinder and a control valve for controlling the application of fluid pressure to said surface of the actuating piston, the arrangement being such that when said control valve is operated to apply a fluid pressure to said actuating piston, the valve member will be lifted from the seating, the fuel flowing from the bore into the first cylinder and after a predetermined movement of the actuating piston, into said second cylinder.

According to a further feature of the invention the apparatus further comprises an auxiliary plunger slidable in a further bore, the auxiliary plunger being actuated by said cam means and the further bore communicating with said first cylinder, said control valve comprising an on/off valve through which fluid can escape from said further bore until the control valve is closed to generate a pressure in the first cylinder sufficient to move the valve member against the resilient means.

An example of a fuel pumping apparatus in accordance with the invention will now be described with reference to the accompanying diagrammatic drawing.

Referring to the drawing the apparatus comprises a rotary cylindrical distributor member 10 which is housed within a surrounding body 11. Formed in the distributor member is a transverse bore 12 in which is located a pair of pumping plunges 13. The plungers 13 are arranged to be moved inwardly as the distributor member rotates, by the action of cam lobes formed on the internal peripheral surface of a surrounding cam ring 14. In practice cam followers will be located between the outer ends of the plungers and the cam ring.

The bore 12 communicates with a longitudinal passage 15 which at one point is in communication with an outwardly extending delivery passage 16 which extends to the periphery of the distributor member and which is arranged to register in turn with a plurality of outlet ports 17 only one of which is shown, in the body part 11. The outlet ports communicate in use, with the injection nozzles of the associated engine. The passage 15 also communicates with a plurality of outwardly extending inlet passages 18 which can communicate in turn with an inlet port or ports 19 in the body part, the inlet port being connected to the outlet of a low pressure fuel supply pump 20.

In use, as the distributor member rotates the delivery passage 16 is brought into register with an outlet 17 following which the plungers 13 are moved inwardly to displace fuel through the outlet port 17 to one of the injection nozzles of the engine. During the inward movement of the plungers the inlet passages 18 are out of register with the inlet port or ports 19. During continued rotation of the distributor member after the plungers have moved inwardly to their maximum extent, the delivery passage 16 is moved out of register with an outlet port 17 and the inlet passages 18 are brought into register with the inlet port or ports 19. While such communication is established, fuel from the outlet of the low pressure pump can flow into the bore 12 to effect outward movement of the plungers 13 to their maximum extent as permitted by the profile of the cam ring or by stops not shown. Thereafter the cycle is repeated.

In order to control the quantity of fuel which is supplied to the associated engine it is arranged to spill fuel from the bore 12 following the start of inward movement of the plungers 13.

A spill valve generally indicated at 21 is provided and this comprises a valve member 22 which is shaped for cooperation with a seating defined about a spill passage 23 which communicates with the bore 12. The spill passage opens into a first cylinder 24 and this in turn opens into a second cylinder 25 of larger diameter. Slidable within the cylinders is a stepped piston member 26 which comprises a smaller actuating piston 27 located in the cylinder 24 and a larger storage piston 28 which is located in the cylinder 25. The valve member 22 in the example, is integrally formed with the piston member. However, for production purposes the piston member may be formed in two parts. The piston member is biased by a spring 29 so that the valve member 22 engages the seating and in this position the actuating piston 27 just enters into the cylinder 24.

The cylinder 24 and the valve member 22 define an annular space which is traversed by a further transversely extending bore 30 in which is located a pair of auxiliary plungers 31. The plungers 31 are actuated at the same time as the plungers 13 by the cam means 14. The annular space is connected by means of a passage 32 extending within the distributor member, with a control passage 33 which can register in turn with a plurality of control ports 34 only one of which is shown, and which each communicate with an electromagnetically operable on/off valve 35. Furthermore, the control port can communicate in turn with supply ports 36 formed in the body part and communicating with the outlet of the low pressure pump 20. The on/off valve is controlled by an electronic control system which can take into account various engine operating parameters such as engine speed and operator demand. The valve may be replaced by some form of device which can operate as will be described, to prevent a flow of fuel from the bore 30 during the inward movement of the plungers 31.

During the inward movement of the pumping plungers 13 the control passage 33 is in register with a control port 34 and with the valve 35 open, as the auxiliary plungers 31 are moved inwardly fuel expelled from the bore 30 will flow through the on/off valve to a drain. The pressure developed in the aforesaid annular space will not be sufficient to move the piston member 26 and valve member 22 from the position shown in the drawing. Fuel will therefore be supplied to the outlet 17. If during inward movement of the plungers the valve 35 is closed, the pressure within the bore 30 and the aforesaid annular space will rapidly increase and this pressure acts upon the end surface of the actuating piston 27 to effect movement of the piston member and also the valve member 22 against the action of the spring 29. As soon as the valve member 22 is lifted from the seating, fuel will flow through the spill port 23 into the annular space. As the piston member moves against the action of its spring the actuating piston 27 will be withdrawn from the end of the cylinder 24 and the fuel can then flow into the larger cylinder. As soon as the valve member 22 is lifted from its seating the pressure of fuel supplied through the outlet 17 will fall to permit rapid closure of the valve member of the fuel injection nozzle and the supply of fuel to the engine will cease. As the plungers 13 and 31 continue their inward movement, the fuel will be displaced into the cylinder 25 to effect movement of the piston member 26 against the action of its spring and such movement will continue until the cam followers associated with the plungers ride over the crests of the cam lobes.

When the plungers are allowed outward movement by the cam lobes, the piston member under the action of the spring 29 will return towards the position shown in the drawing and during such movement fuel will be displaced into the bores 12 and 30 until the valve member again contacts the seating. In the meantime an inlet passage 18 will have moved into register with the inlet port 19 and the control passage 33 will have moved into register with a supply passage 36. Fuel can therefore flow to the bores from the low pressure pump to make up the amount of fuel which has been supplied to the engine and also in the case of the bore 30, any fuel which has been lost due to leakage. In order to assist the movement of the piston member so that the valve member can engage the seating, it is necessary to provide a leakage path from the cylinder 25 and this leakage path can be provided by leakage between the working clearance of the piston 28 and the cylinder or it may be provided by a small drilling communicating with the cylinder 25.

By the arrangement described the auxiliary plungers 31 have only to pressurise a comparatively small volume of fuel in order to develop the necessary pressure to effect movement of the actuating piston 27. As a result the total displacement of the plungers 31 is comparatively small and this means that even when the apparatus is set to supply only a small quantity of fuel to the associated engine, the total movement of the piston member 26 is not greatly increased by the displacement of the auxiliary plungers. If the actuating piston were not provided the plungers would have to pressurise a substantially larger volume of fuel and in order to achieve rapid operation, the plungers would have to be of enlarged diameter thereby resulting in a greater displacement of fuel into the larger cylinder this requiring greater movement of the piston 28 and increased stress in the spring 29. Furthermore, the small area of the actuating piston 27 means that pressure spikes which are generated when the plungers 31 are initially moved by the cam lobes, do not cause movement of the piston and valve member.

The initial lifting of the spill valve 22 is achieved quickly and may result in a cavity being formed in the fuel in the cylinder 25. However, after the piston 27 is withdrawn from the cylinder 24 the spilled fuel enters the cylinder 25 and any cavity which has formed is collapsed. Moreover, since the piston 28 has a greater area than the piston 27 a reduced piston velocity is obtained for a given flow rate of fuel. This helps to reduce the dynamic stress in the return spring 29 to an acceptable level.

I claim:

1. A fuel injection pumping apparatus comprising a plunger reciprocable within a bore, an outlet from the bore and through which fuel can be displaced during the inward movement of the plunger under the action of cam means and a spill valve operable during the inward movement of the plunger to spill fuel from the bore thereby to determine the quantity of fuel supplied through the outlet said spill valve including a valve member engagable with a seating surrounding a spill passage from the bore, resilient means biasing the valve member into engagement with the seating, and actuating piston coupled to said valve member, said actuating piston being slidable in a first cylinder into which said spill port opens, the actuating piston defining a surface against which fluid pressure in said first cylinder can act to lift the valve member from the seating, a second cylinder of larger diameter than the first cylinder and into which the first cylinder opens, a storage piston slidable in the second cylinder and a control valve for controlling the application of fluid pressure to said surface of the actuating piston, the arrangement being such that when said control valve is operated to apply a fluid pressure to said surface the valve member will be lifted from the seating, the fuel flowing from the bore into the first cylinder and after a predetermined movement of the actuating piston into the second cylinder.

2. An apparatus according to claim 1 including an auxiliary plunger slidable in a further bore and actuated by said cam means in synchronism with the pumping plunger, said further bore communicating with said first cylinder and said control valve comprising an on/off valve through which fluid can escape from said further bore until the control valve is closed to generate a pressure in the first cylinder sufficient to move the valve member against the action of the resilient means.

* * * * *